US009243796B1

(12) United States Patent
Elwell et al.

(10) Patent No.: US 9,243,796 B1
(45) Date of Patent: Jan. 26, 2016

(54) LED LAMP WITH A FLEXIBLE HEAT SINK

(71) Applicant: Putco, Inc., Story City, IA (US)

(72) Inventors: James P. Elwell, Grimes, IA (US); Trent Quick, Des Moines, IA (US)

(73) Assignee: Putco, Inc., Des Moines, IA (US)

( * ) Notice: Subject to any disclaimer, the term of this patent is extended or adjusted under 35 U.S.C. 154(b) by 0 days.

(21) Appl. No.: 14/805,602

(22) Filed: Jul. 22, 2015

(51) Int. Cl.

| | |
|---|---|
| ***F21V 29/00*** | (2015.01) |
| ***F21V 29/70*** | (2015.01) |
| ***F21K 99/00*** | (2010.01) |
| ***F21V 23/00*** | (2015.01) |
| ***F21V 29/89*** | (2015.01) |
| ***F21S 8/10*** | (2006.01) |
| *F21Y 101/02* | (2006.01) |

(52) U.S. Cl.
CPC ..... *F21V 29/70* (2015.01); *F21K 9/1355* (2013.01); *F21S 48/328* (2013.01); *F21V 23/002* (2013.01); *F21V 29/89* (2015.01); *F21Y 2101/02* (2013.01)

(58) Field of Classification Search
None
See application file for complete search history.

(56) References Cited

U.S. PATENT DOCUMENTS

2006/0082987 A1* 4/2006 Dorsey ..... F21S 4/003 362/103

OTHER PUBLICATIONS

LED Headlight Kit 9005 LED Headlight Bulbs Conversion Kit with Flexible Tinned Copper Braid, retrieved Nov. 5, 2015 from https://www.superbrightleds.com/moreinfo/h-series-bulbs/led-headlight-kit-9005-led-headlight-bulbs-conversion-kit-with-flexible-tinned-copper-braid/2213/5000/?utm_source=googlebase&utm_medium=base&utm_content=9005-HLV3-H&utm_campai.*

WeissLicht Illustro LED Headlight/Fog Light Bulb, retrieved Nov. 5, 2015 from https://jlevisw.com/Accessories-for-BMW/Lighting/Fog-and-Head-Lights/Illustro-LED-Headlight-Fog-Light-Bulb/.*

* cited by examiner

*Primary Examiner* — Britt D Hanley
(74) *Attorney, Agent, or Firm* — McKee, Voorhees & Sease, PLC

(57) ABSTRACT

An LED lamp uses a flexible metal fabric as a heat sink. At least one light emitting diode is attached to a circuit board that is mounted on a heat conducting member. The flexible heat sink is attached to the heat conducting member, such that heat generated by the light emitting diode and circuit board is conducted to the flexible heat sink. The flexible heat sink can be deformed to fit in a variety of spaces. The flexible heat sink dissipates the heat generated by the LED lamp without the need for a fan. The flexible heat sink may be made from braided copper fabric.

17 Claims, 6 Drawing Sheets

LED LAMP WITH A FLEXIBLE HEAT SINK

FIELD OF INVENTION

The present invention relates generally to vehicle lights that use light emitting diodes (LEDs). More specifically, the invention relates to an LED lamp with a heat sink.

BACKGROUND OF THE INVENTION

In recent years it has become popular to use LED lighting to provide illumination for automobiles, including especially headlights, fog lights, taillights, signal lights, and emergency indicators. LED lights can be superior to filament or gas bulbs in terms of efficiency, life span, size, directional control, light intensity and light quality. High intensity LED lights, especially when used for headlights and fog lights generate a significant amount of heat in their semiconductor junctions. This heat can cause problems such as melting or otherwise deteriorating the LED light itself, or its surroundings. In extreme cases the heat can create a fire risk.

To address the excessive heat problem, it has been known to provide fans or to make a large body out of heavy rigid materials to disperse the heat. Fans are not ideal because they consume energy, take up valuable space, make noise, and tend to wear out before the LED lighting element. Using a large rigid body to act as a heat sink is also problematic because of cost and space requirements. What is needed is a mechanism for removing heat from semiconductor junctions without using a fan and without using a large rigid body.

SUMMARY OF THE INVENTION

According to one embodiment, the present invention is directed to an LED lamp with a heat sink. The lamp includes a wire harness adapted for connection to an electrical system. First and second circuit boards are electrically connected to the wire harness. The circuit boards are mounted on opposite sides of the heat conducting member. A first light emitting diode is provided on the first circuit board, and a second light emitting diode is provided on the second circuit board. A flexible heat sink is mechanically connected to the heat conducting member. The flexible heat sink may be a braided metal band. The braided metal band may be folded into first and second loops. The flexible heat sink may include a first and a second braided metal band, and wherein the first and second braided metal bands are crimped to the heat conducting member with the heat conducting member sandwiched between the braided metal bands. The braided metal band may be made from copper strands. The braided metal band may be made from tinned copper strands. The heat conducting member may be a copper bar. The circuit boards may mounted on the heat conducting member by a heat conducting adhesive. The circuit boards may be mounted to the heat conducting member with the light emitting diodes proximate to a first end of the heat conducting member and the flexible heat sink connected at a second end of the heat conducting member opposite from the first end of the heat conducting member. The light emitting diodes may produce at least 1100 lumens. The LED lamp may be free from fans. The lamp may include a mounting base, wherein the circuit boards and the heat conducting member are enclosed within the mounting base, wherein the mounting base has openings to accommodate the light emitting diodes, and wherein the flexible heat sink extends outwardly out of the mounting base. The electrical system may be an automotive electrical system, and the mounting base may be adapted for attachment to an automobile headlight.

According to another embodiment, the present invention is directed to a method of installing an LED lamp into a light fixture. An LED lamp is provided that has a light emitting diode on a circuit board, a heat conducting member supporting the circuit board, a flexible heat sink made from a flexible metal fabric attached to the heat conducting member, and a mounting body enclosing the circuit board and heat conducting member. The flexible heat sink is shaped in to a desired shape to fit in a space behind the light fixture. The mounting body is mounted in the light fixture with the light emitting diode on a front side of the fixture and the flexible heat sink in the space behind the light fixture. The flexible metal fabric may be formed with a plurality of loops and the shaping step may include expanding the loops. The flexible metal fabric may be braided copper.

DETAILED DESCRIPTION OF PREFERRED EMBODIMENT

Figure 1:
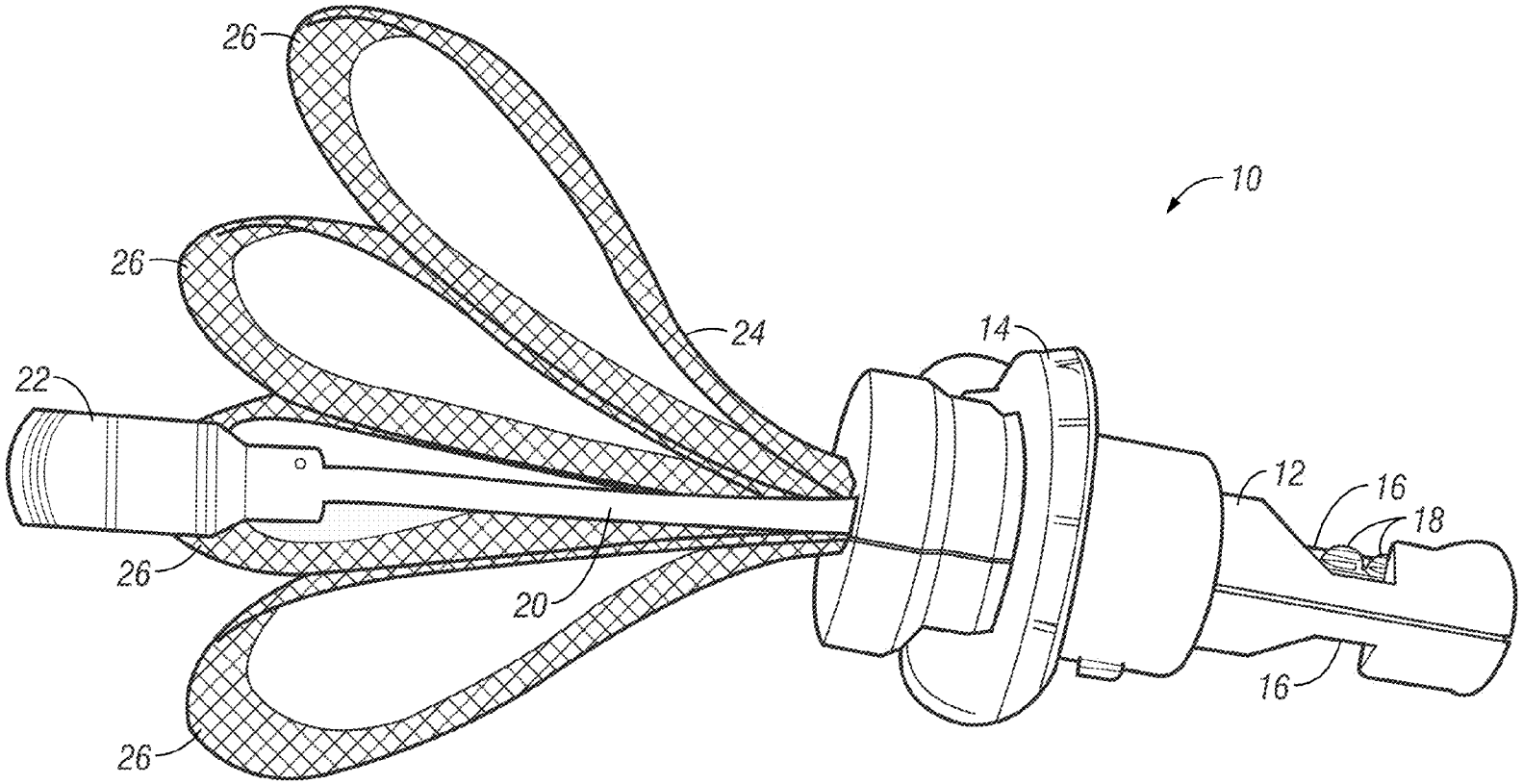
FIG. 1 is a perspective view of a LED lamp with a heat sink according to one embodiment of the present invention.
Figure 2:
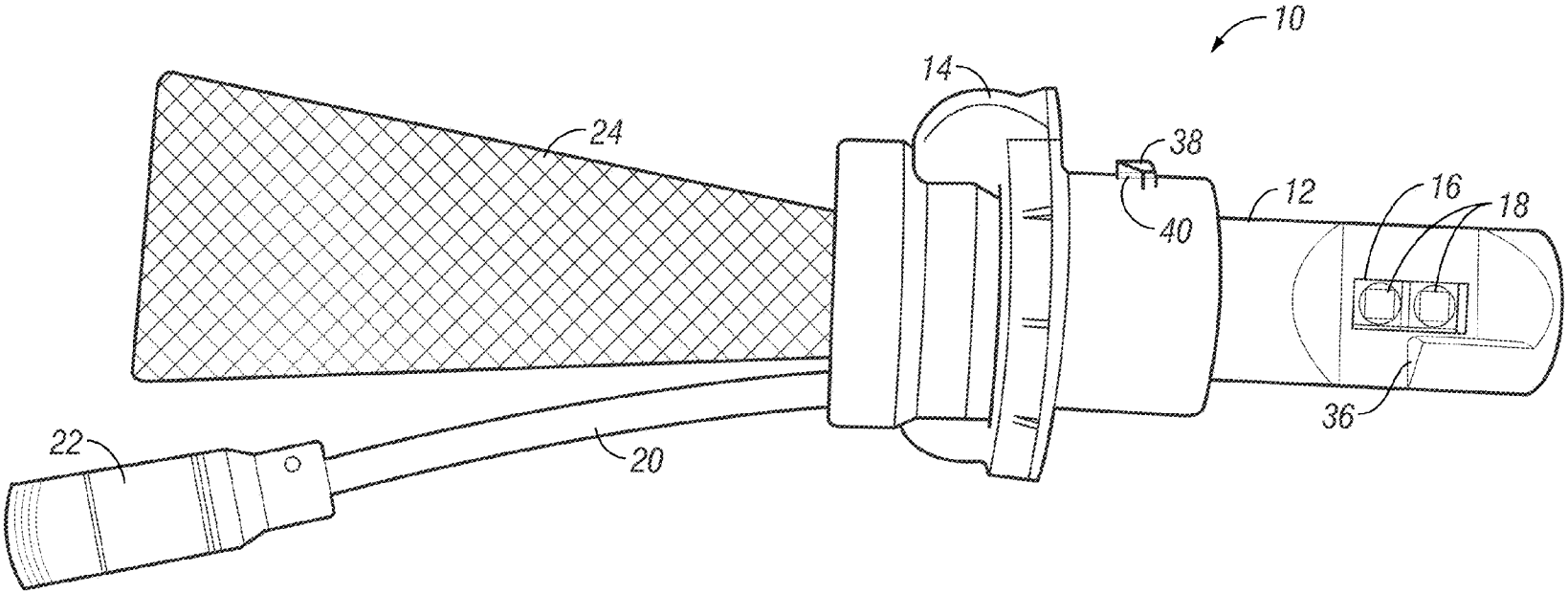
FIG. 2 is a top plan view of the LED lamp of FIG. 1.

FIGS. 1 and 2 show an LED lamp 10 according to one embodiment of the present invention. The LED lamp 10 is adapted for use as a headlight in an automobile. The LED lamp 10 includes a tower body 12 and mounting structure 14 that permit the lamp 10 to be mounted on an automobile. Together the tower body 12 and mounting structure 14 provide a mounting base that is adapted for mounting to a light fixture, such as an automobile headlight. The tower body 12 includes openings 16 through which light emitting diodes 18 are provided. A wire harness 20 extends from one end of the tower body 12. The wire harness 20 includes a plug 22 that is adapted to interface with an LED ballast (not shown) that will connect to the automobiles electrical system. Also extending from the one of the tower body 12 is a flexible heat sink 24. The flexible heat sink 24 includes loops 26 of a metal fabric that can be easily deformed to fit in a variety of spaces depending upon where the lamp 10 is installed.

Figure 3:
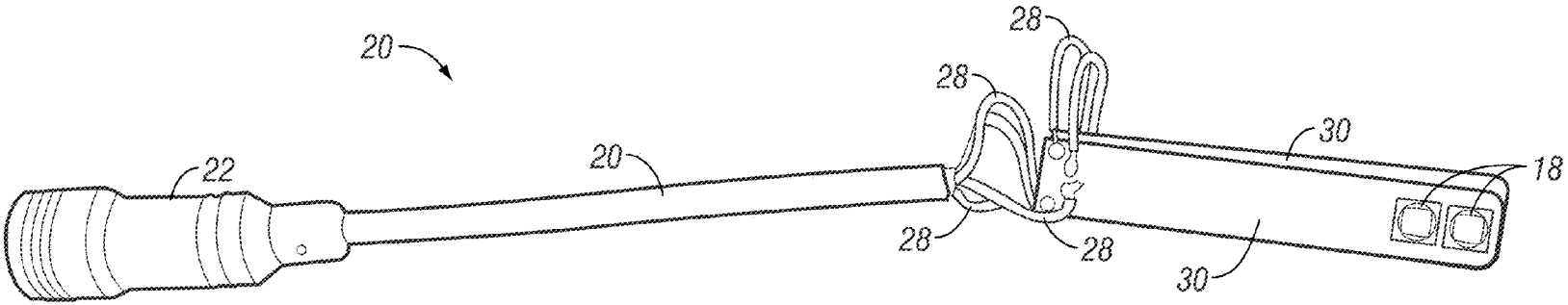
FIG. 3 is a perspective view of a wire harness, circuit boards, and light emitting diodes used in making the LED lamp of FIG. 1.

FIG. 3 shows some of the internal components of the LED lamp 10 of FIGS. 1 and 2. The wire harness 20 includes a plurality of electrically conductive wires 28 that are electrically connected, for example by soldering, to two circuit boards 30. Each of the circuit boards 30 has two light emitting diodes 18 attached at an opposite end of the circuit board 30 from the attachment point of the wires 28. The two light emitting diodes on each circuit board may correspond, for example, with a low beam setting and a high beam setting when used in an automobile. Those of skill in the art will appreciate that any number of light emitting diodes 18 might be used beneficially in the present invention. Furthermore, a single circuit board 30 may be used in some embodiments of the invention. The circuit boards 30 are adapted to control the light emitting diodes according to the input voltage provided through the wire harness 28.

Figure 4:
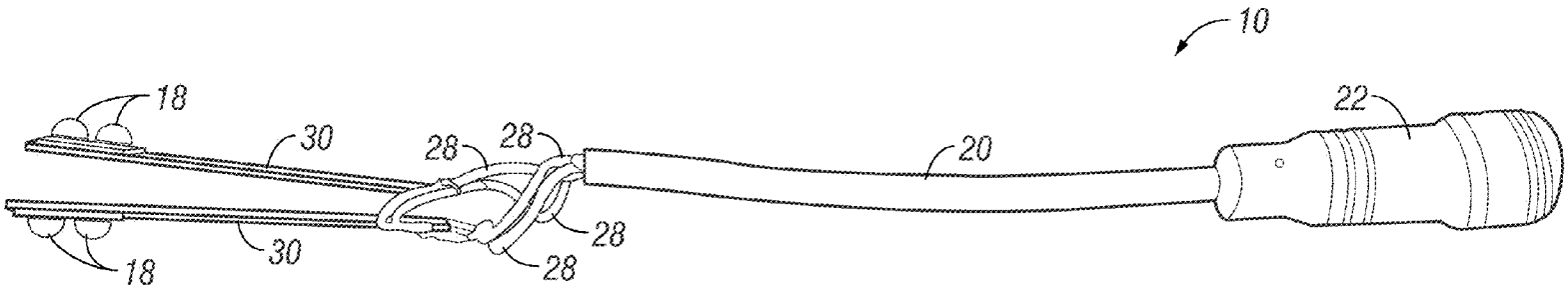
FIG. 4 is a perspective view of the wire harness, circuit boards, and light emitting diodes of FIG. 3.

In manufacturing the LED lamp 10 of FIGS. 1 and 2, the assembly of FIGS. 3 and 4 is created by soldering a wire harness 20 to the circuit boards 30. The circuit boards 30 are available as component parts that include the light emitting diodes 18. Various circuit boards 30 and light emitting diode 18 combinations may be used depending upon the lighting requirements. In the preferred embodiment the light emitting diodes 18 are rated to produce at least 1100 lumens, and preferably about 2500 lumens or more.

Figure 5:
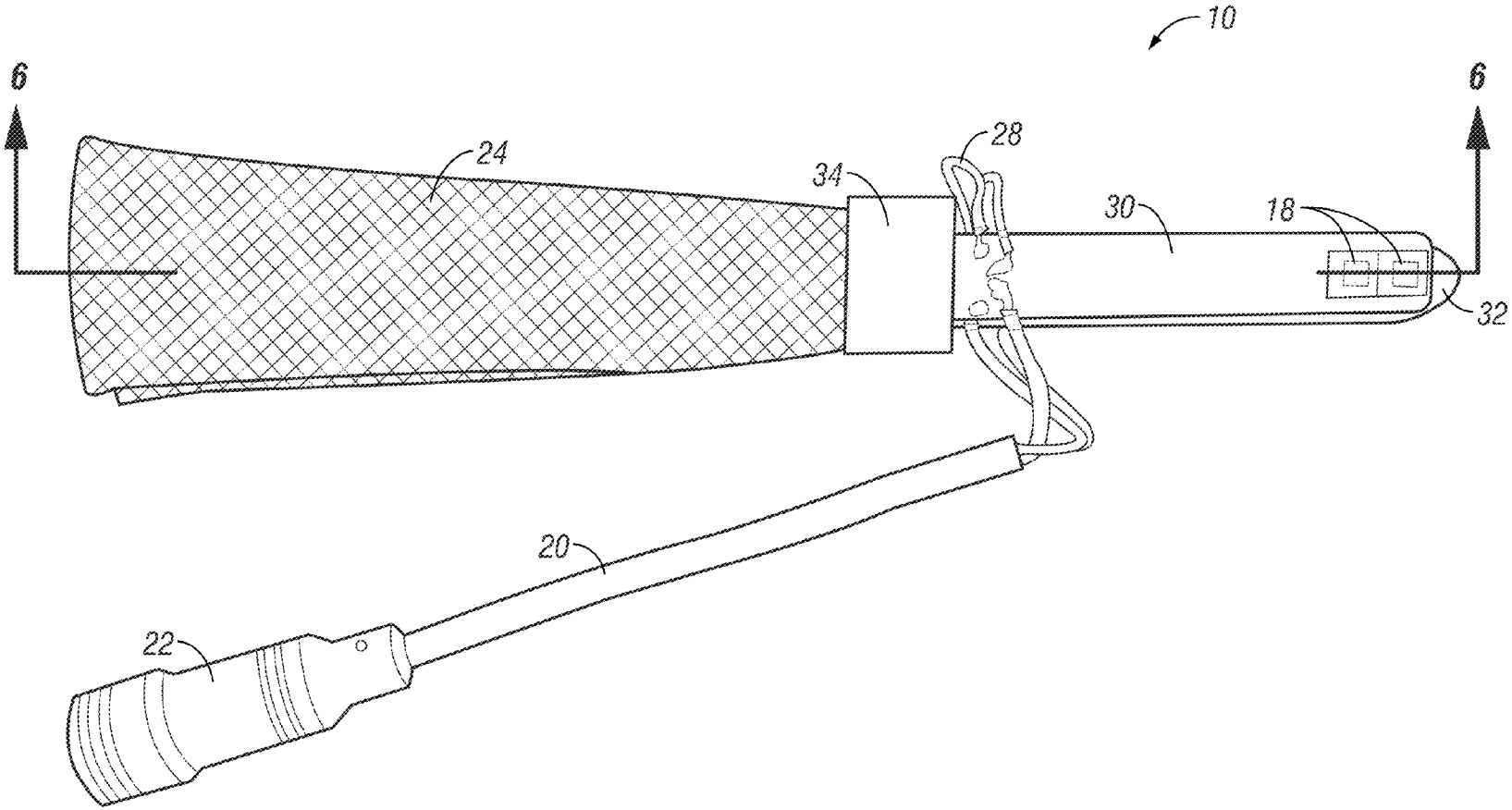
FIG. 5 is a top plan view of the internal components of the LED lamp of FIG. 1 with the tower body and mounting structure removed.

FIG. 5 shows a top plan view of the internal components of the LED lamp 10 with the tower body 12 and mounting structure 14 removed. The circuit boards 30 are mounted on opposite sides of a heat conducting member 32. This circuit boards 30 may be fixed to the heat conducting member 32 by the use of a heat conducting electrically insulating adhesive, such as a two-part epoxy with ultra-high thermal conductivity and adhesive strength. In one embodiment an epoxy under the brand name Silanex Model #ST0903 has been found to be effective. It is important that the circuit boards 30 be in good thermal connection with the heat conducting member 32 such that heat energy can be readily transferred from the circuit boards 30 to the heat conducting member 32. The heat conducting member 32 should be made of a material that is a good conductor of heat, and that is durable enough to serve as a substrate for the circuit boards 30. According to one embodiment, the heat conducting member 32 is made from a copper tube flattened to have the approximate dimensions of 3 inches×0.45 inches×0.12 inches with the ends crimped closed to prevent moisture from entering. Alternatively, the heat conducting member could be formed from a solid copper bar to approximately the same dimensions. Other materials, including especially other metals that are good heat conductors, may be used to form the heat conducting member.

Figure 6:
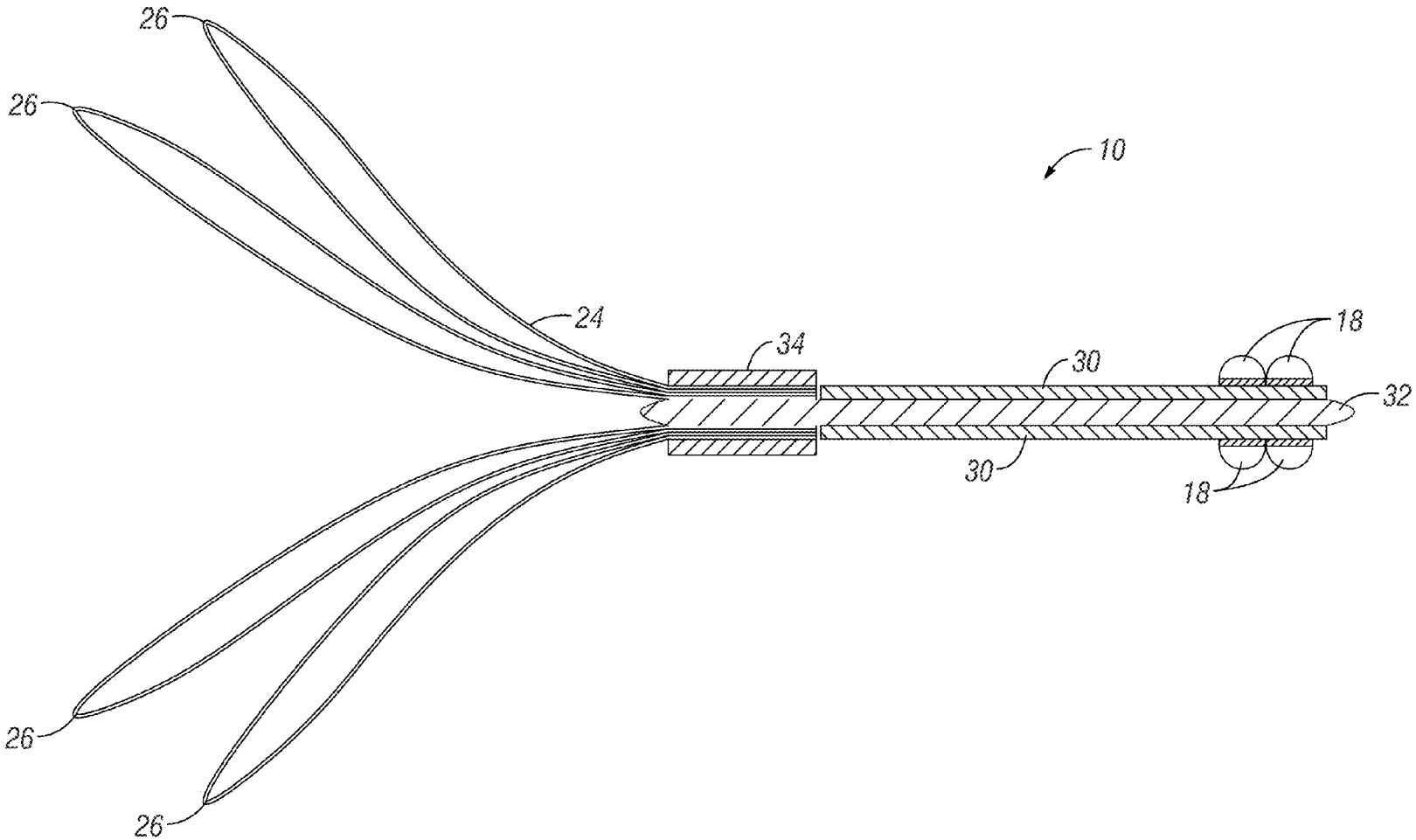
FIG. 6 is a partial cross-section elevation view of the internal components of FIG. 5.

As best seen in the cross-sectional view of FIG. 6, the flexible heat sink 24 is held in place against the heat conducting member 32 by a mechanical crimp 34. Other fastening mechanisms may be used as long as they allow for good thermal contact between the heat sink 24 and the heat conducting member 32. The flexible heat sink 24 of the preferred embodiment is formed from a braided flat copper cable. These braided copper cables are commonly used as battery ground straps. The cable may alternatively be formed from braided or woven tinned copper, or other flexible metal fabrics. In the embodiment of FIG. 6 two sections of cable, each about eight (8) inches long are used. Each section of the cable is folded into two loops 26 of approximately equal size with the free ends captured under the crimp 34.

Figure 7:
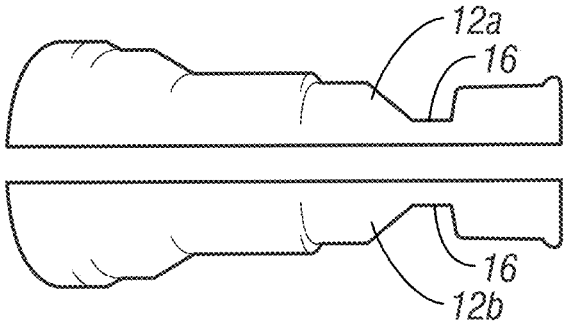
FIG. 7 is an elevation view of two pieces that snap together to form a tower body and enclosure according to one embodiment of the present invention.

To form the finished LED lamp 10 of FIGS. 1 and 2, the assembly of FIG. 6 has a tower body 12 snap fit together covering the circuit boards 30, the heat conducting member 32, and the crimp 34. The tower body 12 provides support for the mounting structure 14 that is used to attach the lamp 10 in place in a light fixture. Furthermore, the tower body 12 protects the circuit boards and the electrical connections from fouling and stresses. The tower body 12 may be formed from two heat resistant nylon molded pieces 12*a* and 12*b* as shown in FIG. 7 that snap fit together to form the tower body 12. The tower body 12 is generally fully closed, except that openings 16 are provided to accommodate the light emitting diodes 18. Additionally, the end of the tower body 12 that is generally opposite from the diode openings 16 includes openings for the wire harness 20 and the flexible heat sink 24.

The tower body 12 may include features near the light emitting diode openings 16 that shape the light emitted by the lamp 10. For example, as best seen in FIG. 2, a projection 36 may be provided near the opening 16 that partially blocks a portion of the light emitted by the light emitting diodes 18, and especially blocks the light from the end-most light emitting diode 18 in one direction to shape the light beam emitted by the lamp 10. The arrangement shown is suitable for use as a headlight lamp that provides a low beam and a high beam. The low beam (lower light emitting diodes) turns off and the upper light emitting diodes are illuminated on each side. In alternative versions the lower light emitting diodes will dim about 50% and the upper light emitting diodes will turn on 100% in high beam mode. In low beam mode the lower light emitting diodes would still be 100% and the upper light emitting diodes will be off.

The tower body 12 may also include molded-in features that aid in mounting the lamp 10 in place. For example, as best seen in FIG. 2, the tower body 12 may include a mounting projection 38 that includes a wedge surface 40 that is used to draw the lamp 10 into tight engagement with a socket in a headlight or other light fixture.

Figure 8:
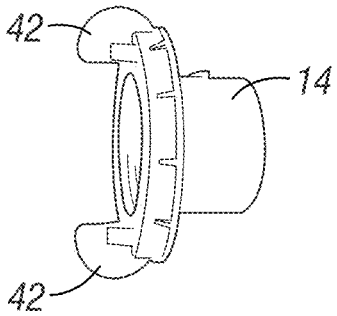
FIG. 8 is a perspective view of a mounting structure from the LED lamp of FIG. 1.

FIG. 8 shows the mounting structure 14 according to one embodiment of the present invention. The mounting structure 14 fits around the outer surface of the tower body 12 and may be friction fit or adhered to the body 12. The mounting structure 14 includes wings 42 acts as a handle or lever to aid in twisting the lamp 10 into place in a socket of a light fixture, such as a headlight. A gasket or O ring (not shown) may be provided to seal the lamp 10 with the fixture when mounted in the socket.

When mounting the lamp 10 in a socket or other fixture space, the flexible heat sink 24 can be molded and deformed to best fit in the available space. The loops 26 of the heat sink 24 are preferably spread apart as much as the space permits to increase the surface area and to allow a greater volume of air between the loops. The ability of the loops 26 to take on a variety of shapes is a significant advantage for the present invention. The metal fabric, such as braided copper, that is used to form the flexible heat sink 24 has some memory, but will generally retain the new shape given in deforming the heat sink 24 to install it. When installing the lamp 10 it is desirable to spread out the loops 26 both in terms of making the loops larger to increase the space between the surfaces of the heat sink 24 and in terms of making the strand wider to increase the surface area.

In use, the heat created by the junctions of the light emitting diodes 18 will be transferred into the heat conducting member 32. Because the heat conducting member 32 is made from an excellent heat conducting material, such as copper, the vast majority of the generated heat energy will be transferred to the flexible heat sink 24 by conduction. The flexible heat sink 24 relies on its large surface area to dissipate the heat by convection and some radiation into the space behind the light fixture. Therefore, even lamps that produce 2500 lumens or more of light may be utilized without fans and without large rigid bodies to dissipate the heat energy. This allows for greater flexibility in mounting locations, reduced costs, greater durability, and less noise.

As used herein, the term "automobile" is used to generically refer to wheeled motor vehicles of all types. While the expected primary use of the invention is in over-the-road passenger vehicles such as cars, sport utility vehicles, and pick-ups, it is contemplated that the invention may be useful in other vehicles such as industrial vehicles, over-the-road semi-tractors, agricultural vehicles, and the like. It is also contemplated that the LED lamp with heat sink described herein may be useful in other applications such as boating, home and industrial uses.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

We claim:

1. An LED lamp with a heat sink, the lamp comprising:

a wire harness adapted for connection to an electrical system;

a first circuit board electrically connected to the wire harness;

a second circuit board electrically connected to the wire harness;

a heat conducting member, wherein the circuit boards are mounted on opposite sides of the heat conducting member;

a first light emitting diode on the first circuit board;

a second light emitting diode on the second circuit board;

a flexible heat sink mechanically connected to the heat conducting member; and wherein the flexible heat sink comprises a flexible metal fabric.

2. The LED lamp of claim 1, wherein the flexible metal fabric comprises a braided metal band.

3. The LED lamp of claim 2, wherein the braided metal band is folded into first and second loops.

4. The LED lamp of claim 2, wherein the flexible heat sink comprises a first and a second braided metal band, and wherein the first and second braided metal bands are crimped to the heat conducting member with the heat conducting member sandwiched between the braided metal bands.

5. The LED lamp of claim 2, wherein the braided metal band comprises copper strands.

6. The LED lamp of claim 2, wherein the braided metal band comprises tinned copper strands.

7. The LED lamp of claim 1, wherein the heat conducting member comprises a copper bar.

8. The LED lamp of claim 7, wherein the circuit boards are mounted on the heat conducting member by a heat conducting adhesive.

9. The LED lamp of claim 1, wherein the circuit boards are mounted to the heat conducting member with the light emitting diodes proximate to a first end of the heat conducting member and further wherein the flexible heat sink is connected at a second end of the heat conducting member opposite from the first end of the heat conducting member.

10. The LED lamp of claim 1, wherein the light emitting diodes produce at least 1100 lumens.

11. The LED lamp of claim 10, wherein the LED lamp is free from fans.

12. The LED lamp of claim 1, further comprising a mounting base, wherein the circuit boards and the heat conducting member are enclosed within the mounting base, wherein the mounting base has openings to accommodate the light emitting diodes, and wherein the flexible heat sink extends outwardly out of the mounting base.

13. The LED lamp of claim 12, wherein the wire harness is adapted for connection to an automobile electrical system.

14. The LED lamp of claim 1, wherein the mounting base is adapted to mount within an automobile headlight fixture.

15. A method of installing an LED lamp into a light fixture comprising:

providing an LED lamp that has a light emitting diode on a circuit board, a heat conducting member supporting the circuit board, a flexible heat sink made from a flexible metal fabric attached to the heat conducting member, and a mounting body enclosing the circuit board and heat conducting member;

shaping the flexible heat sink into a desired shape to fit in a space behind the light fixture; and installing the mounting body in the light fixture with the light emitting diode on a front side of the fixture and the flexible heat sink in the space behind the light fixture.

16. The method of claim 15, wherein the flexible metal fabric is formed with a plurality of loops and wherein the shaping step comprises expanding the loops.

17. The method of claim 16, wherein the flexible metal fabric comprises braided copper.

* * * * *